US011320225B1

(12) United States Patent
Fly

(10) Patent No.: US 11,320,225 B1
(45) Date of Patent: May 3, 2022

(54) DEVICE AND METHODFOR LOCKING A GUN AND ENSURING ITS FIRING CHAMBER IS EMPTY

(71) Applicant: Tekoa Associates Inc., Manchester, TN (US)

(72) Inventor: David E. Fly, Manchester, TN (US)

(73) Assignee: TEKOA ASSOCIATES INC., Manchester, TN (US)

( * ) Notice: Subject to any disclaimer, the term of this patent is extended or adjusted under 35 U.S.C. 154(b) by 0 days.

(21) Appl. No.: 17/318,235

(22) Filed: May 12, 2021

(51) Int. Cl.
*F41A 17/44* (2006.01)

(52) U.S. Cl.
CPC ..... *F41A 17/44* (2013.01)

(58) Field of Classification Search
CPC ..... F41A 17/44; F41A 17/42; F41C 33/06; F41C 27/00
See application file for complete search history.

(56) References Cited

U.S. PATENT DOCUMENTS 3,022,598 A 2/1962 Wikstrom
4,412,397 A 11/1983 Bayn
4,569,144 A 2/1986 Thurber
4,783,924 A 11/1988 Thurber
4,961,277 A 10/1990 Rosenbaum
4,969,284 A 11/1990 Healey et al.
5,001,854 A * 3/1991 Derman ..... F41A 17/44 42/70.11
5,016,377 A * 5/1991 Gunning ..... F41A 17/44 42/70.11
5,099,596 A 3/1992 Butler, Jr.
5,241,770 A * 9/1993 Lambert ..... F41A 17/44 42/70.11
5,261,177 A 11/1993 Armstrong
5,412,959 A * 5/1995 Bentley ..... E05B 67/003 42/66
5,446,988 A * 9/1995 Frederick, Jr. ..... F41A 17/44 42/66
5,664,358 A * 9/1997 Haber ..... F41A 17/44 42/44
6,526,684 B1 * 3/2003 Hickerson ..... F41A 17/44 42/70.01
6,578,308 B2 6/2003 Hickerson
6,604,313 B1 * 8/2003 Kress ..... F41A 17/44 42/70.11
8,555,540 B2 * 10/2013 Woodford ..... F41A 17/42 42/70.11
2004/0025394 A1 * 2/2004 Young ..... F41A 17/44 42/70.11
2012/0030982 A1 * 2/2012 Inskeep ..... F41A 17/44 42/70.01

* cited by examiner

*Primary Examiner* — Joshua E Freeman
(74) *Attorney, Agent, or Firm* — bobharter.com; Robert J. Harter

(57) ABSTRACT

A firearm inhibiting device and method of using the same is disclosed which will only mount onto the firearm if the firing chamber is empty of ammunition (a live cartridge). Further inhibiting, for handguns the device prevents operation of the gun's action mechanism. Further inhibiting, for long-guns the device prevents a live cartridge from entering the firing chamber. The empty chamber indication is unique in that it will indicate an empty firing chamber while the action is prevented from operation and in the battery position.

14 Claims, 5 Drawing Sheets

DEVICE AND METHODFOR LOCKING A GUN AND ENSURING ITS FIRING CHAMBER IS EMPTY

FIELD OF THE DISCLOSURE

This patent generally pertains to firearms and more specifically to devices and methods for inhibiting the firearm's unauthorized use or accidental discharge.

BACKGROUND

A firearm (also known as a gun) is an apparatus comprising a barrel, an action mechanism, and a firing chamber from which one or more projectiles are propelled by an explosive. The firing chamber at a breech end of the barrel is where a live cartridge is situated just prior firing. A cartridge comprises a cartridge case containing the explosive and holds the bullet or projectile(s). When fired, the explosive propels the bullet out through a muzzle end of the barrel. Depending on the type of firearm, the action mechanism provides one or more functions. Examples of such functions include firing the gun, ejecting the spent cartridge case after firing, and/or reloading the next live cartridge into the firing chamber.

Many firearms can be classified in one of two categories, a handgun and a long gun. The term, "long gun," as used herein, refers to any firearm with a barrel length of at least sixteen inches. Some long guns include a stock for bracing the firearm against a shooter's shoulder. The term, "handgun," as used herein, refers to any firearm with a barrel length of less than sixteen inches.

Many long guns can be further classified in one of two categories, a rifle and a shotgun. The term, "rifle," as used herein, refers to a long gun having a barrel with a helically grooved bore, known as rifling. Rifles typically fire a projectile or bullet that prior to firing is attached to and projects forward from a cartridge case. Many long guns utilize a variety of types of action mechanisms (e.g., bolt action, lever action, pump action, etc.).

The term, "shotgun," as used herein, refers to a long gun having a barrel with usually a smooth bore. Shot guns typically fire one or more projectiles that prior to firing are enclosed within a cartridge case.

Many handguns can be further classified in one of two categories, a pistol and a revolver. The term, "pistol," as used herein, refers to a handgun with a single firing chamber. Pistols typically include a striker-fired firing pin or a hammer-fired firing pin. In a pistol the firing chamber is usually integral to the barrel. In a pistol, the action mechanism includes a slide that moves a live cartridge into the firing chamber and ensures the action mechanism is in battery position, then fires it (e.g., via a hammer or striker-fired pin), and then ejects the case from the firing chamber. The battery position is when the cartridge is ready to be fired and a breech cover is in position to fire the live cartridge. With a pistol, bullets are discharged sequentially from the same firing chamber.

The term, "revolver," as used herein, refers to a handgun with a revolving cylinder containing a series of chambers. When rotation of the cylinder places one of the chambers in collinear alignment with the breech end of the barrel, the aligned chamber becomes the firing chamber. In a revolver, the firing chamber is separate from the barrel, but at the breech end and is in alignment with the barrel. The action mechanism of a revolver is the cylinder with its associated mechanism that rotates the next chamber into battery position, fires it, and then rotates that chamber out of battery position while bringing in the next chamber to battery position. Initially, each firing chamber is loaded with a live cartridge. After firing a live cartridge, the revolver's action mechanism rotates the cylinder to move the chamber with the spent cartridge away from the breech end of the barrel and move the next chamber with a live cartridge in its place to be fired at the next shot.

Various devices are available for inhibiting unauthorized use of a firearm and for preventing it from being accidentally discharged. Such devices typically disable one or more functional elements of a firearm. Examples of such functional elements include the firearm's trigger, barrel and hammer.

DETAILED DESCRIPTION

Figure 1:
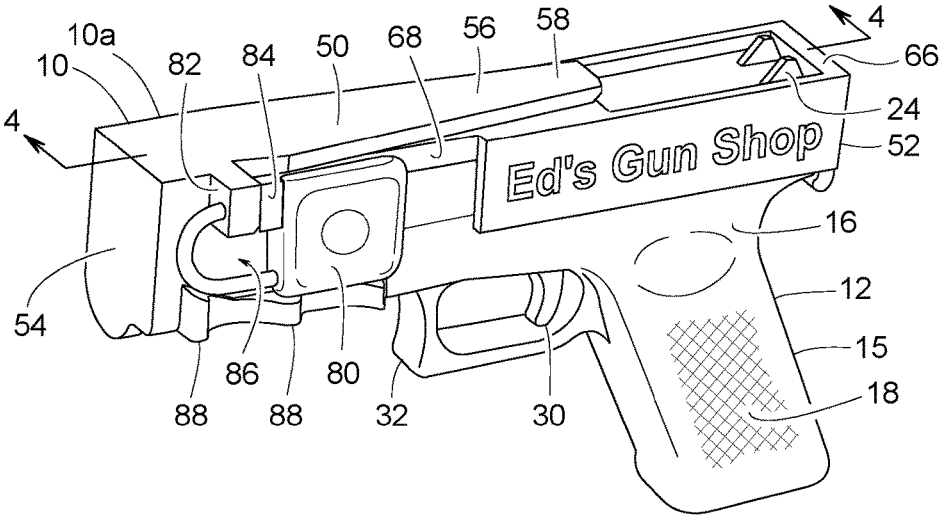
FIG. 1 is a perspective view of an example gun-locking device attached to an example firearm. The gun-locking device attached to an example firearm thus provides a visual indicator that the firing chamber is empty.

FIGS. 1-17 show example gun-locking devices 10 (e.g., gun-locking devices 10*a*, 10*b*, 10*c*, and 10*d*) for inhibiting unauthorized use of a firearm 15 and preventing it from being accidentally discharged. The term, "firearm," as used herein, refers to any apparatus comprising a barrel, an action mechanism, and a firing chamber from which one or more projectiles (e.g., a bullet, shot, etc.) are propelled by an explosive. Some examples of firearm 15 include a pistol 12 (e.g., a hammer or a striker fired), a revolver 96, and a long gun 104 (e.g., a rifle or a shotgun). Each gun-locking device 10 includes a rod extending through a barrel of the firearm 15 and into the firing chamber to ensure there is no bullet or live cartridge in the chamber.

In the example shown in FIGS. 1-4, the gun-locking device 10*a* is attachable to the pistol 12 with a barrel 14 that is less than 16 inches long. In this example, the pistol 12 comprises a frame 16, a grip 18, the barrel 14, a front sight 20 at a muzzle end 22, a rear sight 24 at a breech end 26, a hammer 28 at the breech end 26, a trigger 30, a trigger guard 32, a firing chamber 34 defined by at least one of the frame 16 and the barrel 14, and an action mechanism 36 (e.g., a slide action). The action mechanism 36 is movably attached to the frame 16 to (a) enable firing of the pistol 12, (b) eject a spent cartridge case 38 after firing, and (c) reload a next live cartridge 46 into the firing chamber 34. In some examples, the pistol 12 includes a firing pin 42 for delivering the hammer's impact to a primer of a live cartridge 40 when loaded in the firing chamber 34. In some examples of the pistol 12, a striker-fired firing pin (without the hammer 28) is what delivers an impact to the primer.

Figure 4:
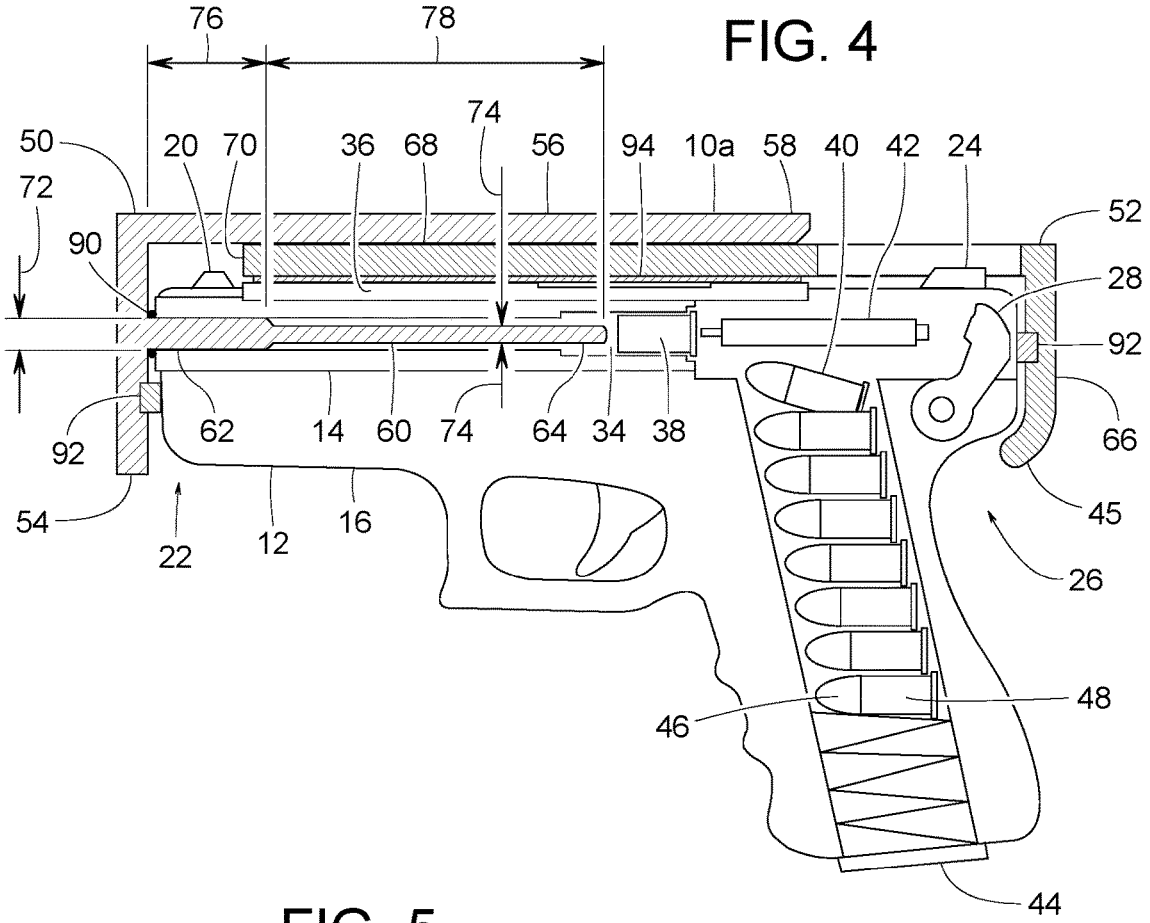
FIG. 4 is a cross-sectional view taken along line 4-4 of FIG. 1, wherein the firearm is shown generally upright.

Some examples of pistol 10*a* include a magazine 44 for feeding live cartridges 40 individually to the firing chamber 34. In some examples, each cartridge 40 comprises a bullet 46 attached to the front end of a cartridge case 48. FIG. 4 happens to show an empty spent cartridge case 38 in firing chamber 34. In some examples, the firing chamber 34 at times is completely empty. In some examples, the firing chamber 34 contains a live cartridge 40 with the bullet 46 still attached to the cartridge case 48.

In some examples, as shown in FIGS. 1-4, gun-locking device 10*a* comprises a muzzle retainer 50 and a breech retainer 52. In some examples, the muzzle retainer 50 comprises a front member 54 and a front arm 56. In some examples, the front arm 56 has a front distal end 58 extending rearward from the front member 54. Some examples of gun-locking device 10*a* include a rod 60 with a proximal end 62 and a distal end 64, wherein the proximal end 62 is adjacent and attached to the front member 54 of the muzzle retainer 50. In some examples, the rod's distal end 64 extends rearward away from the front member 50.

In some examples, the breech retainer 52 comprises a rear member 66 and a rear arm 68. In some examples, the rear arm 68 has a distal end 70 extending forward from the rear member 66.

Figure 2:
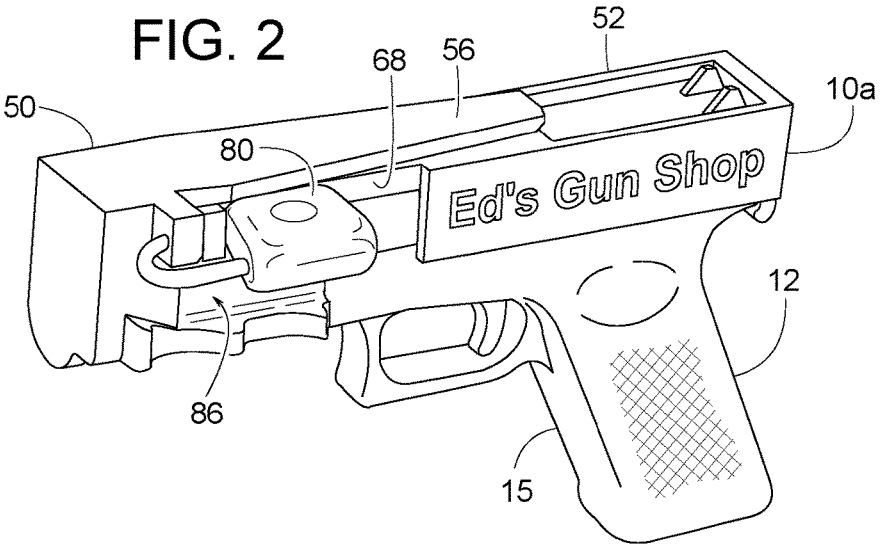
FIG. 2 is a perspective view similar to FIG. 1 but showing an example lock extending out from within a cavity of the gun-locking device.
Figure 3:
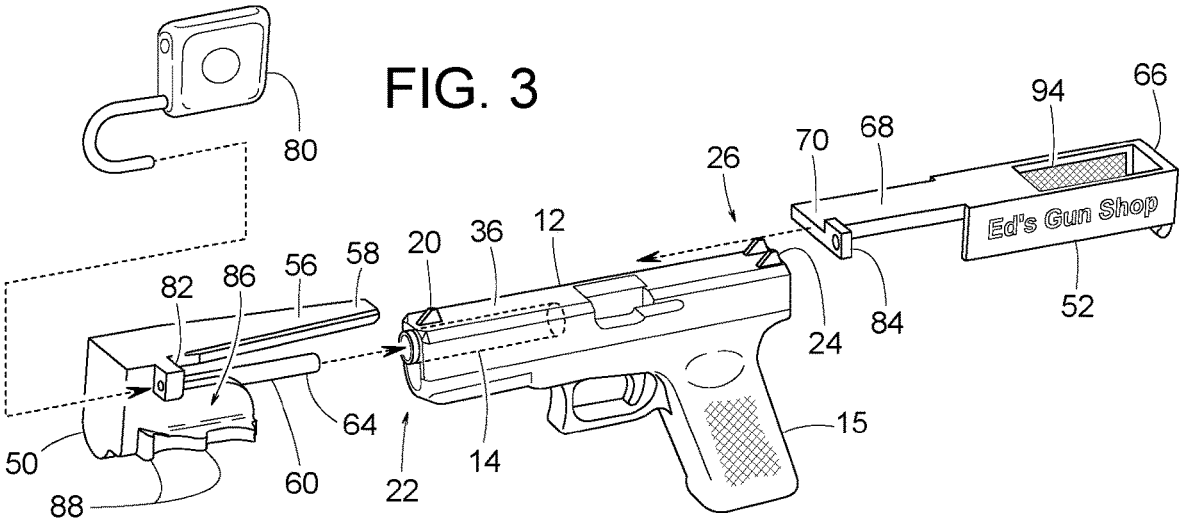
FIG. 3 is an exploded perspective view of the gun-locking device and firearm shown in FIGS. 1, 2, and 4.

In some examples, gun-locking device 10*a* is configurable selectively to a locked configuration (FIGS. 1, 2, and 4) and a released configuration (FIG. 3). In some examples of the locked configuration, the front member 54 and the rear member 66 are slid together to capture the pistol 12 between the gun-locking device's front member 54 and rear member 66.

More specifically, in some examples of the locked configuration, the front member 54 engages the pistol's muzzle end 22, the rear member 66 engages the pistol's breech end 26, and the front arm 56 overlaps both the rear arm 68 and the barrel 14. In some examples, the front arm 56 and the rear arm 68 overlap directly above the pistol's action mechanism 36 to hold them onto the pistol and thus prevent the action mechanism 36 from operating.

In some examples of the locked configuration, the front member 54 of the muzzle retainer 50 is closer to the rear member's rear distal end 70 than to the front member's front distal end 58. In some examples of the locked configuration, the breech retainer's rear member 52 is closer to the front member's front distal end 58 than to the rear member's rear distal end 70.

In some examples of the locked configuration, the rod 60 extends through the barrel 14 and at least partially into the firing chamber 34 to ensure that the firing chamber 34 is empty or at least void of a live cartridge 40 with an attached bullet 46. In some examples, the rod's proximal end 62 has an outer diameter 72 that is larger than an outer diameter 74 of the rod's distal end 64. In some examples, the rod's proximal end 62 has an axial length 76 that is at least three times greater than the proximal end's outer diameter 72 but is shorter than an axial length 78 of the rod's distal end 64. In some examples, the proximal end's larger diameter 72 is nearly the same as the barrel's inner diameter to provide a close slip fit between the two, yet the distal end's relatively small diameter 74 makes it easier to inert and remove the rod 60 without significant drag between the rod 60 and the bore of the barrel 14.

In some examples, the close diametric fit along with the magnitude of the proximal end's axial length 76 limits how far the muzzle retainer's front arm 56 can tilt upward away from the barrel 14 and the breech retainer's rear arm 68. Thus, in some examples, the muzzle retainer's front arm 56 prevents breech retainer 52 from tilting up and off of the pistol's breech end 26. Moreover, in some examples, the muzzle retainer's front arm 56 holds the breech retainer's rear arm 68 securely down against the pistol's action mechanism 36, thereby preventing the action mechanism 36 from operating when the gun-locking device 10*a* is in the locked configuration.

Some examples of gun-locking device 10*a* include a lock 80 to secure the muzzle retainer 50 to the breech retainer 52, and thus prevent an unauthorized person from using the pistol 12 when the gun-locking device 10*a* is in the locked configuration. Lock 80 represents any means for locking the muzzle retainer 50 to the breech retainer 52. Some examples of lock 80 are in the form of a padlock. Some examples of lock 80 are integrally incorporated in gun-locking device 10 itself. Some example means for operating lock 80 include entering a combination, turning a key, reading an RFID device, reading a fingerprint, reading a magnetic field, etc. FIG. 3 shows an example of the lock 80 being in an unlocked state. FIGS. 1 and 2 show an example of the lock 80 being in a locked state.

In some examples, the muzzle retainer 50 includes a front tab 82, and the breech retainer 52 includes a rear tab 84. In some examples, the lock 80 secures the front tab 82 to the rear tab 84 when the gun-locking device 10*a* is in the locked configuration.

In some examples, at least one of the muzzle retainer 50 and the breech retainer 52 defines a cavity 86 (e.g., a recess, a pocket, etc.) in which the lock 80 can be compactly stored while the lock 80 is in the locked state. When stored within the cavity 86, the lock 80 is less likely to flop around. In some examples, the lock 80 is movable selectively in and out of the cavity 86 while the gun-locking device 10*a* is in the locked configuration. FIG. 1, for example, shows the lock 80 held in the cavity 86, and FIG. 2 shows the lock 80 having been swung out from within the cavity 86. Being able to swing the lock 80 out from within the cavity 86 makes it easier to open and close the lock 80.

Some examples of muzzle retainer 50 include a plurality of knuckle knobs 88 below the cavity 86. In some examples, the knuckle knobs 88 help define cavity 86 and provide one or more protrusion for a user's hand to push against when moving the muzzle retainer 50.

Some examples of gun-locking device 10*a* include additional features that make it more functional and/or more protective of the pistol's surface finish. Some examples of gun-locking device 10*a* include a non-metallic or polymeric ring 90 (e.g., a rubber O-ring, an annular gasket, etc.) encircling the rod's proximal end 62 to prevent the muzzle retainer 50 from scratching the muzzle end 22 of the pistol 12. Some examples of gun-locking device 10*a* include a magnet 92 on the muzzle retainer's front member 54 and/or on the breech retainer's rear member 66 to help hold the muzzle retainer 50 and the breech retainer 52 in place while the lock 80 is being installed. Some examples of gun-locking device 10*a* include a non-metallic liner 94 on at least one of the muzzle retainer 50 and the breech retainer 52 to prevent the gun-locking device 10*a* from scratching various surfaces of the pistol 12.

Figure 5:
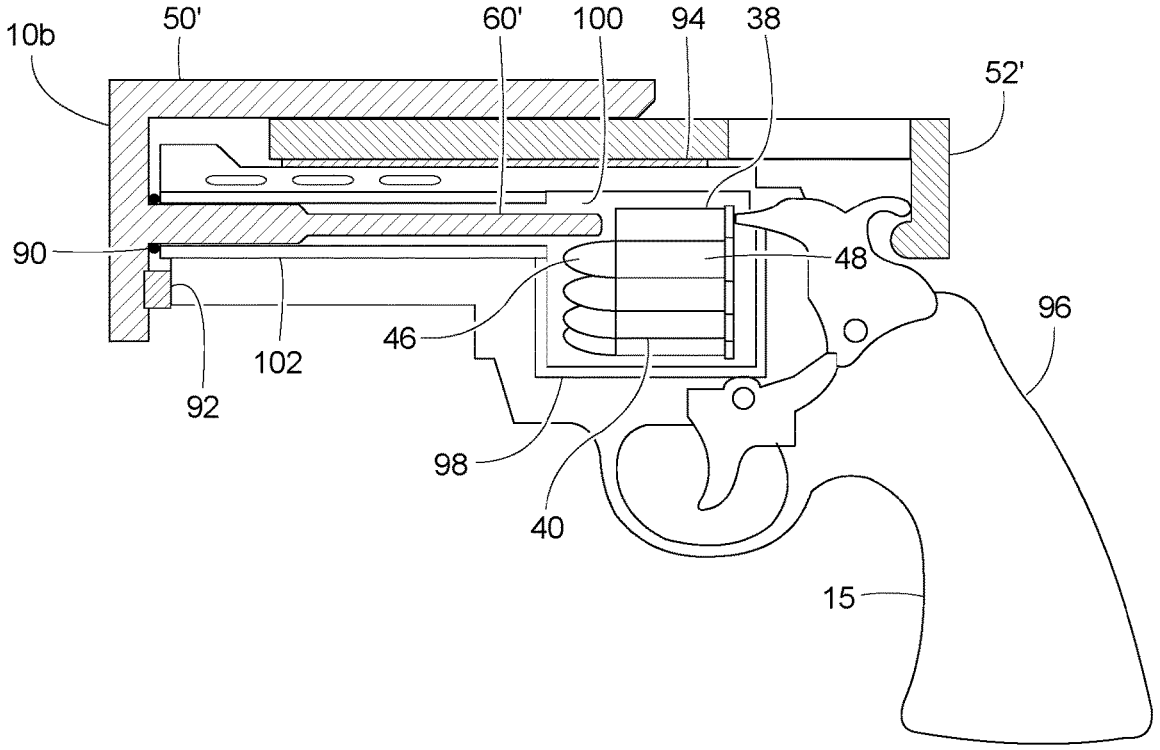
FIG. 5 is a cross-sectional view similar to FIG. 4 but showing another example gun-locking device on another example firearm, wherein the firearm is shown generally upright.

Gun-locking device 10*a* can be custom designed to fit different firearms. FIG. 5, for example, shows the gun-locking device 10*b* comprising a muzzle retainer 50' and a breech retainer 52', which correspond to the muzzle retainer 50 and the breech retainer 52, respectively. The gun-locking device 10*b*, of FIG. 5, is very similar to the gun-locking device 10*a*, of FIGS. 1-4, but is sized and shaped to fit the revolver 96 rather than the pistol 12.

In some examples, the revolver 96 includes a cylinder 98 containing a series of chambers 100. Rotating the cylinder 98 selectively places one of the chambers 100 in collinear alignment with the revolver's barrel 102, whereby the aligned chamber 100 becomes a firing chamber. When gun-locking device 10*b* is in the locked configuration, as shown in FIG. 5, a rod 60' of the muzzle retainer 50' extends into the one firing chamber 100 that is aligned with the barrel 60', thereby ensuring that the aligned firing chamber 100 is completely empty or at least void of a bullet 46.

In the example shown in FIGS. 6-14, the gun-locking device 10*c* is designed to fit even a long gun 104 (e.g., a rifle or a shotgun) with a barrel length of at least sixteen inches. It should be clear, of course, that the gun-locking device 10*c* can be of any size and length to fit other firearms 15, such as handguns, pistols with striker-fired firing pins, pistols with hammer-fired firing pins, and revolvers. In the illustrated example, the long gun 104 comprises a barrel 106 with a muzzle end 108, a firing chamber 110, an action mechanism 112, a trigger 114, and a stock 116. In some examples, the gun-locking device 10*c* extends through the barrel 106, into the firing chamber 110, and is locked there to disable the firearm 15 (e.g., long gun 104).

In some examples, the gun-locking device 10*c* comprises a sleeve 118 with a rod 120 extending through the sleeve 118. In some examples, the sleeve 118 is elongate in an axial direction 122. In some examples, the sleeve 118 defines a hole 124 for receiving the lock 80. In some examples, the sleeve 118 includes a collet 126 and a flange 128. In some examples, the collet 126 has a collet diameter that varies between an expanded diameter 130 and a relaxed diameter 132, wherein the expanded diameter 130 is greater than a barrel diameter 134, and the relaxed diameter 132 is less than the barrel diameter 134.

In some examples, the firing chamber 110 has a chamber diameter 125 that is sufficient to contain a cartridge case 48 and a bullet 46 prior to the bullet 46 being fired. In some examples, the chamber diameter 125 is larger than the barrel diameter 134, thus the collet 126 can expand radially within the firing chamber 110.

In some examples, the rod 120 is elongate in the axial direction 122. In some examples, the rod 120 defines a cavity 136 that provides clearance for the lock 80. Some examples of cavity 136 include a groove, a detent, an aperture, a hole, a notch, etc. In some examples, the rod 120 includes a head 138 and a handle 140.

Figure 6:
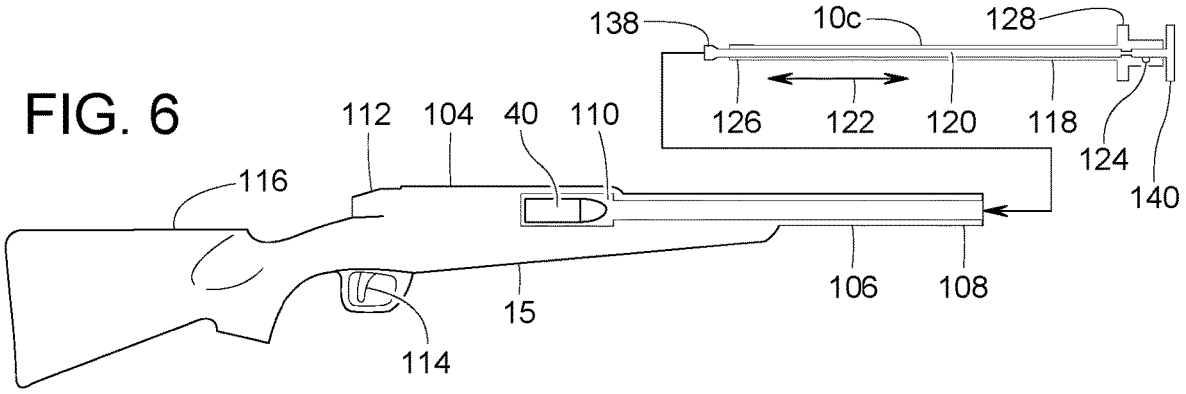
FIG. 6 is a cross-sectional side view of another example gun-locking device about to be attached to another example firearm.

In some examples, the gun-locking device 10*c* is configurable selectively in a locked configuration (FIG. 10) and a released configuration (FIG. 6). In some examples, in the locked configuration, the flange 128 engages the muzzle end 108, the collet 126 extends into the firing chamber 110, the head 138 forces the collet 126 radially outward to the expanded diameter 130, and the hole 124 in the sleeve 118 is aligned with the cavity 136 in the rod 120 with respect to the axial direction 122.

In some examples, in the released configuration, the sleeve 118 is spaced apart from the firearm (e.g., the long gun 104), the hole 124 in the sleeve 118 is misaligned with the cavity 136 in the rod 120 with respect to the axial direction 122, and the collect 126 is at the relaxed diameter 132.

In some examples, the gun-locking device 10*c* can be reconfigured from the released configuration to the locked configuration by following the example steps illustrated sequentially in FIGS. 6-10. FIG. 6 shows a live cartridge 40 in the firing chamber 110, so the cartridge 40 would first need to be removed to provide room for the gun-locking device 10*c* to extend into the firing chamber 110. FIG. 6 shows the rod's head 138 and the sleeve's collect 126 being axially offset, which leaves the collet 126 at the relaxed diameter 132 for easily inserting the sleeve 118 and the rod 120 into the barrel 106.

Figure 7:
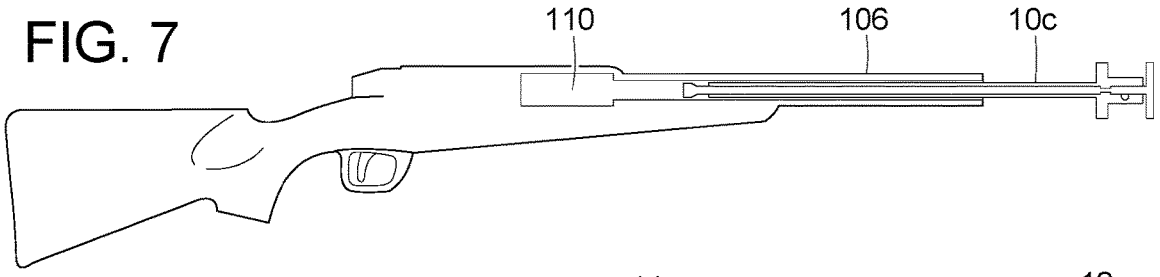
FIG. 7 is cross-sectional side view similar to FIG. 6 but showing the gun-locking device partially inserted in the firearm.

FIG. 7 shows the firing chamber 110 empty. FIG. 7 also shows the gun-locking device 10*c* being slid into the barrel 106.

Figure 8:
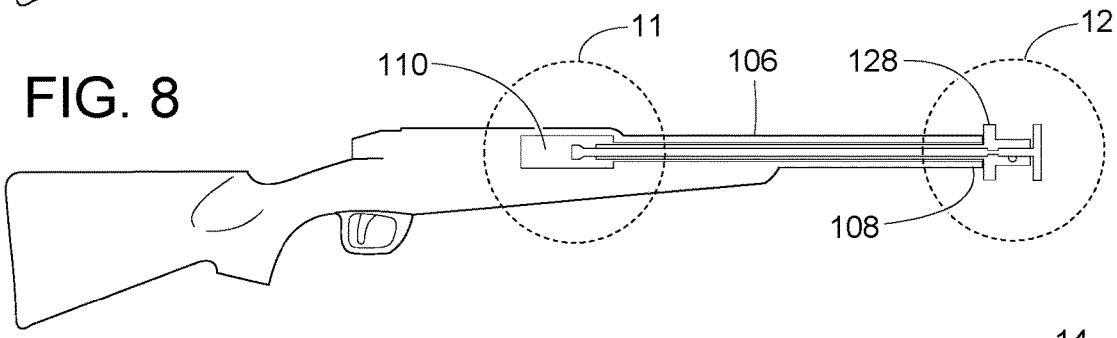
FIG. 8 is cross-sectional side view similar to FIG. 7 but showing the gun-locking device fully inserted in the firearm.

FIG. 8 shows the sleeve's flange 128 abutting the muzzle end 108, which indicates that the gun-locking device 10*c* is fully inserted into the barrel 106 and extends into the firing chamber 110. The sleeve's flange 128 abutting the muzzle end 108 thus provides a visual indicator that the firing chamber 110 is empty.

Figure 9:
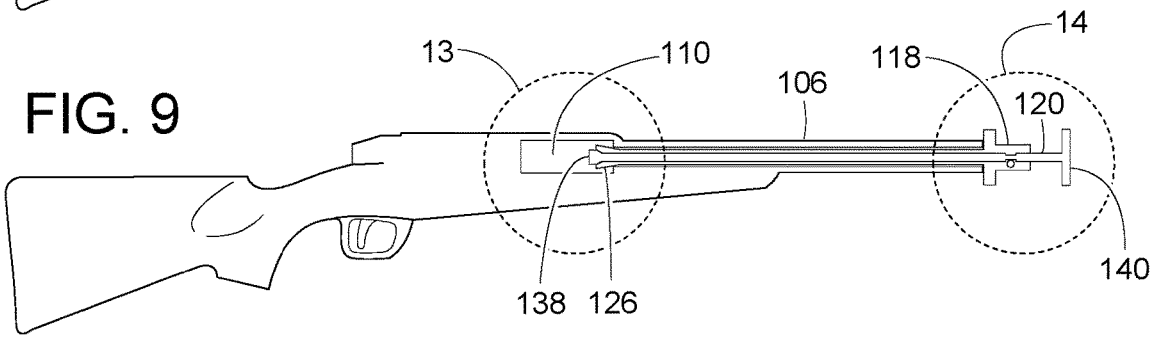
FIG. 9 is cross-sectional side view similar to FIG. 8 but showing a portion of the gun-locking device radially expanded inside the firing chamber of the firearm.

FIG. 9 shows the rod 120 partly withdrawn from sleeve 118, whereby the rod's handle 140 is now axially spaced apart from the sleeve 118. In this position, the rod's head 138 has forced the collect 126 to its expanded diameter 130. The collect 126 is shown having expanded radially into the firing chamber 110 and is now too large to pull back out through the barrel 106, as the barrel diameter 134 is smaller than the collet's expanded diameter 130. When rod 120 has been pulled to radially expand the collet 126, as shown in FIG. 9, the rod's cavity 136 becomes aligned with the sleeve's hole 124 to allow the insertion of the lock 80. In some examples, the cavity 136 is in the form of a groove fully encircling the rod 120. With the cavity 136 being a circular groove, the rod 120 and the sleeve 118 do not have to be in any particular rotational relationship in order to insert the lock 80.

Figure 10:
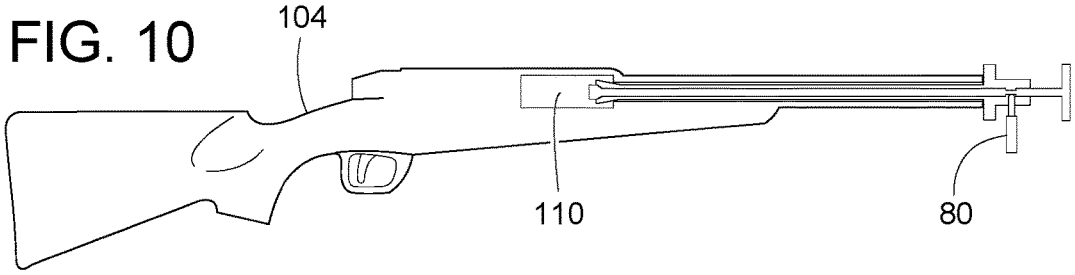
FIG. 10 is cross-sectional side view similar to FIG. 9 but the gun-locking device locked.
Figure 11:
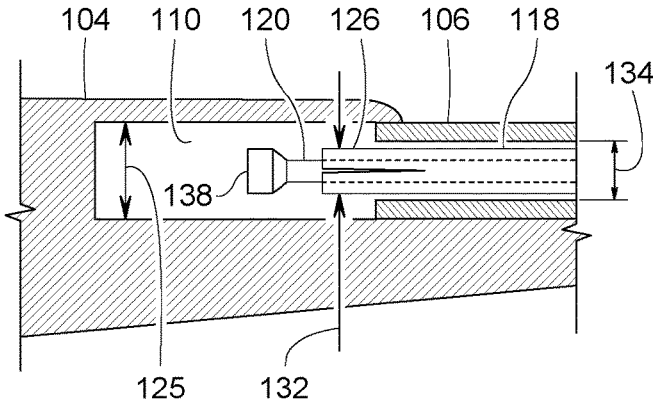
FIG. 11 is a cross-sectional view of the encircled area identified by numeral 11 in FIG. 8.
Figure 12:
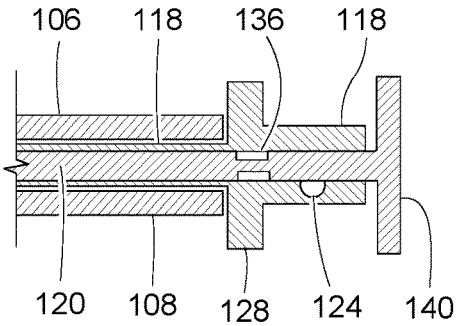
FIG. 12 is a cross-sectional view of the encircled area identified by numeral 12 in FIG. 8.
Figure 13:
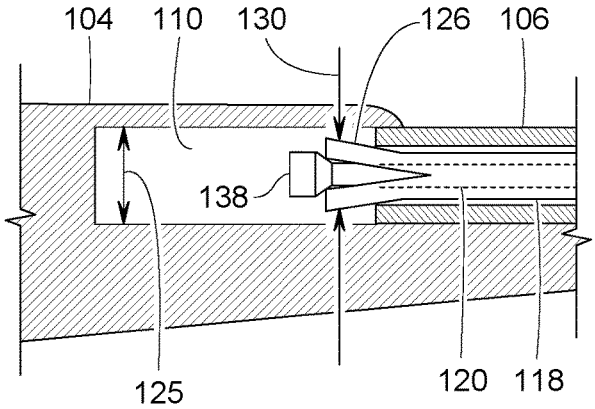
FIG. 13 is a cross-sectional view of the encircled area identified by numeral 13 in FIG. 9.
Figure 14:
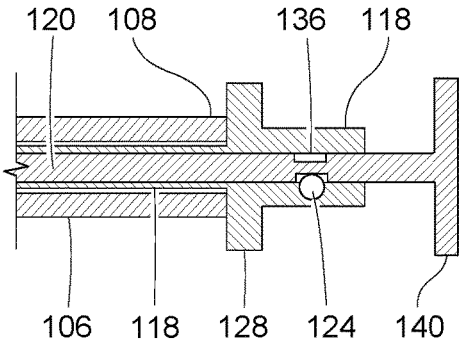
FIG. 14 is a cross-sectional view of the encircled area identified by numeral 14 in FIG. 9.

FIG. 10 shows the lock 80 having been inserted through the hole 124 and the cavity 136. FIG. 10 thus shows gun-locking device 10*c* in its locked configuration.

Figure 15:
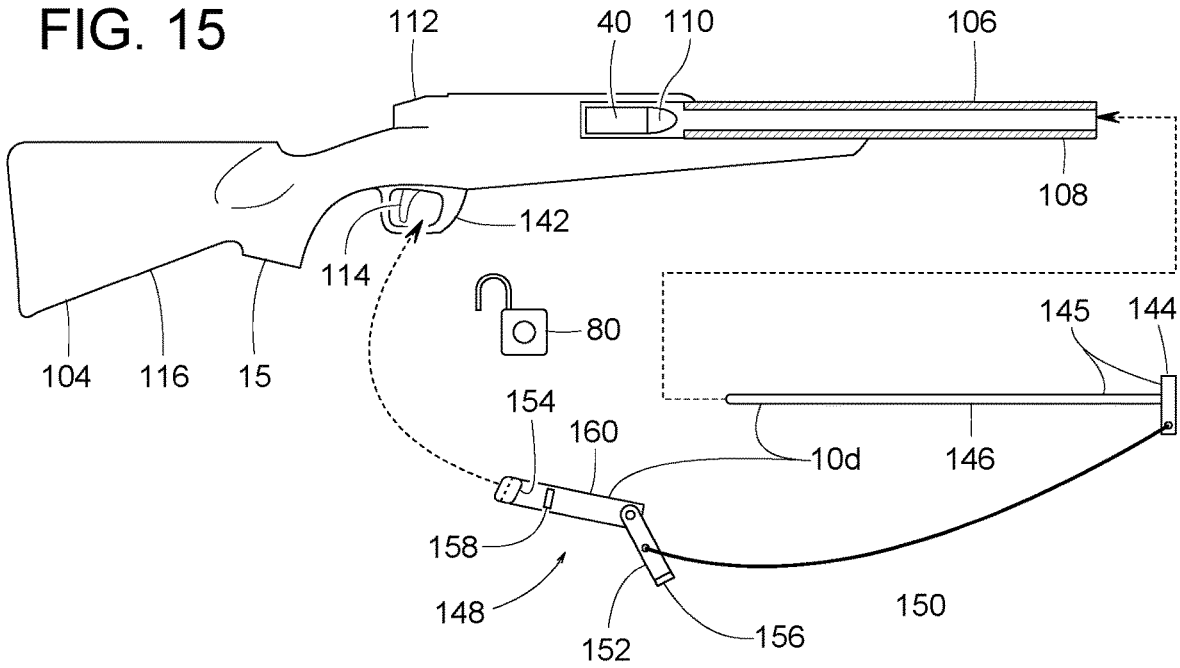
FIG. 15 is a cross-sectional side view of another example gun-locking device about to be attached to another example firearm.
Figure 16:
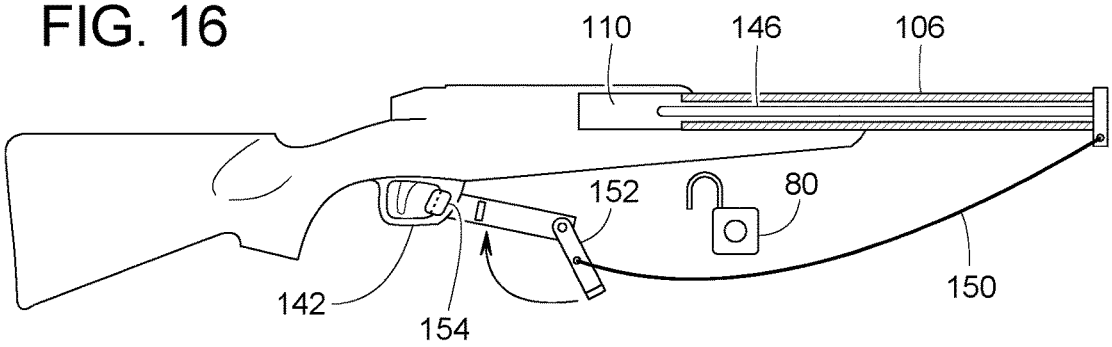
FIG. 16 is cross-sectional side view similar to FIG. 15 but showing the gun-locking device inserted into the firearm.
Figure 17:
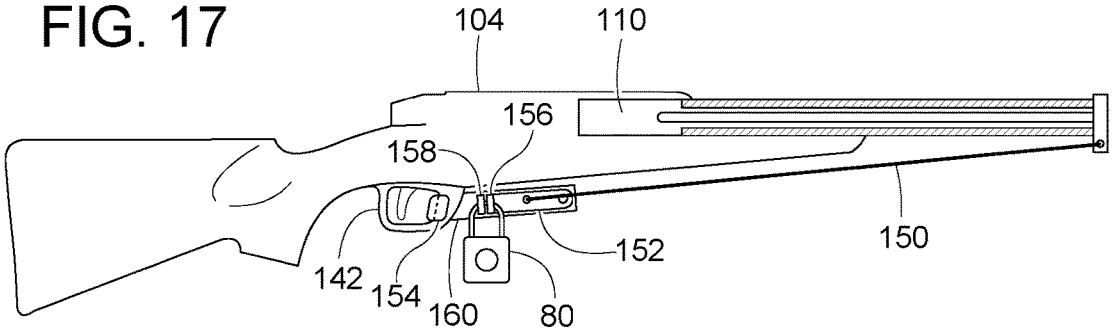
FIG. 17 is cross-sectional side view similar to FIG. 16 but the gun-locking device locked.

In the example shown in FIGS. 15-17, the gun-locking device 10*d* is designed to fit even a long gun 104 (e.g., a rifle or a shotgun) with a barrel length of at least sixteen inches. It should be clear, of course, that the gun-locking device 10*d* can be of any size and length to fit other firearms 15, such as handguns, pistols and revolvers. In the illustrated example, the long gun 104 comprises the barrel 106 with the muzzle end 108, the firing chamber 110, the action mechanism 112, the trigger 114, and a trigger guard 142. In some examples, the gun-locking device 10*d* extends through the barrel 106, into the firing chamber 110, and is locked there to disable the firearm 15.

In some examples, the gun-locking device 10*d* comprises a muzzle retainer 145 that includes a front member 144 and a rod 146 extending from the front member 144. In some examples, the gun-locking device 10*d* comprises a connector 148, the lock 80, and a pliable elongate member 150 extending between the muzzle retainer 145 and the connector 148. Some examples of the pliable elongate member 150 include a plastic coated metal cable, a wire, a chain, etc.

In some examples, the gun-locking device 10*d* is configurable selectively to a locked configuration (FIG. 17) and a released configuration (FIG. 15). In some examples, in the locked configuration, the front member 144 of the muzzle retainer 145 engages the muzzle end 108, the rod 146 extends through the barrel 106 and into the firing chamber 110 of the firearm (e.g., the long gun 104), the connector 148 is attached to the trigger guard 142, and the lock 80 is attached to the pliable elongate member 150 and/or the connector 148. In some examples, in the released configuration, the muzzle retainer 145 is spaced apart from the firearm (e.g., the long gun 104).

In some examples, the connector 148 includes a toggle arm 152 that is movable selectively to a taut position (FIG. 17) and a loose position (FIGS. 15 and 16), wherein the pliable elongate member 150 is held in greater tension when the toggle arm 152 is in the taut position than in the loose position while the gun-locking device 10*d* is in the locked configuration.

In some examples, the gun-locking device 10*d* can be reconfigured from the released configuration to the locked configuration by following the example steps illustrated sequentially in FIGS. 15, 16, and 17. FIG. 15 shows the live cartridge 40 in the firing chamber 110, so the cartridge 40 would first need to be removed to provide room for the gun-locking device 10*d* to extend into the firing chamber 110. FIG. 15 shows gun-locking device 10*d* in the released configuration spaced apart from the long gun 104.

FIG. 16 shows the rod 146 having been inserted into the barrel 106 such that the rod 146 extends into the firing chamber 110. In some examples, the muzzle retainer's front member 144 abutting the muzzle end 108 provides an indicator that the rod 146 is extending into the firing chamber 110, and thus the firing chamber 110 is empty. In some examples, the connector 148 includes a hook 154. In the illustrated example, FIG. 16 shows the connector 148 being hooked onto the trigger guard 142 (and/or hooked onto the trigger 114). FIG. 16 also shows the toggle arm 152 in the loose position. In the loose position, pliable elongate member 150 is loose to allow the hook 154 to be readily hooked onto the trigger guard 142.

FIG. 17 shows the toggle arm 152 having been swung over to the taut position to place the pliable elongate member 150 in tension. In some examples, the lock 80 is installed (installed position) to hold the toggle arm 152 at its taut position and thus hold gun-locking device 10*d* at its locked configuration. In some examples, the lock 80 in the installed position (shown in FIG. 17) fastens a first tab 156 on toggle arm 152 to a second tab 158 on a base 160 of the connector 148. In some examples, the lock 80 in a removed position (FIGS. 15 and 16) enables the toggle arm 152 to move from the taut position to the loose position.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A gun-locking device attachable to a firearm, the gun-locking device being configurable selectively to a locked configuration and a released configuration, the firearm comprising a barrel, the firearm comprising a muzzle end from which a fired bullet can exit the barrel, the firearm comprising a breech end located opposite the muzzle end of the firearm, the firearm comprising a firing chamber at the breech end for firing the firearm, the firearm comprising a trigger, the firearm being generally upright when the barrel is substantially horizontal while the trigger is extending down below the barrel, the gun-locking device comprising:

a muzzle retainer comprising a front member and a front arm, the front arm having a front distal end extending from the front member;

a breech retainer comprising a rear member and a rear arm, the rear arm having a rear distal end extending from the rear member;

in the locked configuration while the firearm is upright, the front member engaging the muzzle end, the rear member engaging the breech end, the front arm overlapping both the rear arm and the barrel, the front member of the muzzle retainer being closer to the rear distal end than to the front distal end, the rear member of the breech retainer being closer to the front distal end than to the rear distal end, at least some of the front arm extending over and above the firearm, and at least some of the rear arm extending over and above the firearm; and in the released configuration, the muzzle retainer and the breech retainer are spaced apart from the firearm.

2. The gun-locking device of claim 1, wherein the firearm includes an action mechanism being movable to transfer a cartridge into a firing chamber of the firearm when the gun-locking device is in the released configuration, and the action mechanism being interposed and substantially immovable between the barrel and at least one of the front arm and the rear arm when the gun-locking device is in the locked configuration.

3. The gun-locking device of claim 1, wherein the front distal end is closer to the rear member than to the front member when the gun-locking device is in the locked configuration.

4. The gun-locking device of claim 1, wherein the firearm includes a firing chamber for receiving a cartridge prior to firing the firearm, and the gun-locking device further comprising a rod extending from the front member of the muzzle retainer such that the rod extends through the barrel and into the firing chamber when the gun-locking device is in the locked configuration.

5. The gun-locking device of claim 4, wherein the rod includes a rod proximal end and a rod distal end, the rod proximal end being adjacent to the front member of the muzzle retainer, the rod distal end extending into the firing chamber when the gun-locking device is in the locked configuration, the rod proximal end being of a larger diameter than the rod distal end, and the rod proximal end being axially shorter than the rod distal end.

6. The gun-locking device of claim 1, wherein at least some of the rear arm is both underneath the front arm and above the firearm when the firearm is upright and in the locked configuration.

7. The gun-locking device of claim 1, further comprising a magnet on the front member of the muzzle retainer.

8. The gun-locking device of claim 1, further comprising a magnet on the rear member of the breech retainer.

9. The gun-locking device of claim 1, further comprising a lock without serrations having selectively a locked state and an unlocked state, the lock securing the muzzle retainer to the breech retainer without serrations when the gun-locking device is in the locked configuration while the lock is in the locked state, and the muzzle retainer being separable from the breech retainer when the lock is in the unlocked state.

10. The gun-locking device of claim 9, wherein at least one of the muzzle retainer and the breech retainer defines a cavity in which the lock can be stored while the lock is in the locked state, the lock being movable selectively in and out of the cavity while the gun-locking device is in the locked configuration.

11. A gun-locking device attachable to a firearm, the gun-locking device being configurable selectively to a locked configuration and a released configuration, the firearm defining a firing chamber having a chamber diameter sufficient to contain a cartridge case and a bullet prior to the bullet being fired, the firearm comprising a barrel having a barrel diameter that is less than the chamber diameter, the firearm comprising a muzzle end from which the bullet can exit the barrel, the gun-locking device comprising:

a sleeve being elongate in an axial direction, the sleeve defining a hole and comprising a collet and a flange, the collet having a collet diameter that varies between an expanded diameter and a relaxed diameter, the expanded diameter being greater than the barrel diameter, and the relaxed diameter being less than the barrel diameter;

a rod being elongate in the axial direction, the rod extending into the sleeve, the rod defining a cavity and comprising a head and a handle, wherein the cavity is a groove extending circumferentially around the rod;

in the locked configuration, flange engaging the muzzle end of the firearm, the collet extending into the firing chamber, the head forcing the collet radially outward to the expanded diameter, the hole in the sleeve being aligned with the cavity in the rod with respect to the axial direction; and in the released configuration, the sleeve being spaced apart from the firearm, the hole in the sleeve being misaligned with the cavity in the rod with respect to the axial direction, and the collect being at the relaxed diameter.

12. The gun-locking device of claim 11, further comprising a lock extending into the hole and the cavity when the gun-locking device is in the locked configuration.

13. A gun-locking device attachable to a firearm, the gun-locking device being configurable selectively to a locked configuration and a released configuration, the firearm comprising a barrel through which a bullet can be discharged out through a muzzle end of the barrel, the firearm defining a firing chamber of sufficient size to contain a cartridge case and the bullet prior to the bullet being discharged through the barrel, the firearm comprising a trigger for firing the firearm, the firearm comprising a trigger guard at least partially surrounding the trigger, the gun-locking device comprising:

a muzzle retainer comprising a front member and a rod extending from the front member;

a connector;

a lock;

a pliable elongate member extending between the muzzle retainer and the connector;

in the locked configuration, the front member of the muzzle retainer engaging the muzzle end, the rod extending through the barrel and into the firing chamber of the firearm, the connector being attached to at least one of the trigger and the trigger guard, the lock being attached to at least one of the pliable elongate member and the connector, wherein the connector comprises a toggle device that is movable selectively to a taut position and a loose position, the pliable elongate member being held in greater tension when the toggle device is in the taut position than in the loose position while the gun-locking device is in the locked configuration; and in the released configuration, the muzzle retainer being spaced apart from the firearm.

14. The gun-locking device of claim 13, further comprising a lock having selectively an installed position and a removed position, the lock holding the toggle device in the taut position when the lock is in the installed position while the gun-locking device is in the locked configuration, the lock enabling the toggle device to move from the taut position to the loose position when the lock is in the removed position.

* * * * *